US008816231B2

(12) United States Patent
Shen

(10) Patent No.: US 8,816,231 B2
(45) Date of Patent: Aug. 26, 2014

(54) SLIM KEY STRUCTURE AND SLIM KEYBOARD HAVING THE SAME

(75) Inventor: Hai-Nan Shen, Dong Guan (CN)

(73) Assignees: Lite-On Electronics (Guangzhou) Limited, Guangzhou (CN); Lite-On Technology Corporation, Taipei (TW)

( * ) Notice: Subject to any disclaimer, the term of this patent is extended or adjusted under 35 U.S.C. 154(b) by 190 days.

(21) Appl. No.: 13/571,994

(22) Filed: Aug. 10, 2012

(65) Prior Publication Data

US 2013/0264182 A1 Oct. 10, 2013

(30) Foreign Application Priority Data

Apr. 5, 2012 (CN) ..... 2012 1 0096678

(51) Int. Cl.
*H01H 1/10* (2006.01)

(52) U.S. Cl.
USPC ..... 200/516; 200/345

(58) Field of Classification Search
USPC ..... 200/516, 345
IPC ..... H01H 13/705,13/7057, 13/7065
See application file for complete search history.

(56) References Cited

U.S. PATENT DOCUMENTS

| | | | | |
|---|---|---|---|---|
| 5,516,996 | A * | 5/1996 | Shin | 200/345 |
| 6,242,705 | B1 * | 6/2001 | Huang | 200/520 |
| 8,624,144 | B2 * | 1/2014 | Chiang | 200/345 |
| 2008/0308397 | A1 * | 12/2008 | Chou | 200/5 A |

* cited by examiner

*Primary Examiner* — Vanessa Girardi
(74) *Attorney, Agent, or Firm* — Li & Cai Intellectual Property (USA) Office

(57) ABSTRACT

A slim key structure includes a lower case having at least one positioning slot, a flexible membrane disposed on the lower case, an upper case dispose on the flexible membrane, a keycap and an elastic piece. The flexible membrane has a post opening corresponding to the positioning slot. The upper case has at least one hollow guiding cylinder and a central passage. The guiding cylinder is protruded upwardly and downwardly from the upper case, and the downward protruding portion of the guiding cylinder is received in the positioning slot. The keycap has at least one guiding post and a pushing stem protruding downwardly from a bottom surface thereof. The guiding post is reciprocably received in the guiding cylinder. The elastic piece is disposed between the keycap and the flexible membrane in the central passage depressable by the pushing stem against the flexible membrane.

19 Claims, 8 Drawing Sheets

SLIM KEY STRUCTURE AND SLIM KEYBOARD HAVING THE SAME

BACKGROUND OF THE INVENTION

1. Field of the Invention

The present invention relates to a slim key structure and slim keyboard having the same. In particular, the present invention relates to a slim key structure with a guiding structure, which including guiding posts on a keycap and an orientation structure on a housing matching the guiding posts, and a slim keyboard having the same.

2. Description of Related Art

Electronic products, including input devices such as keyboards, are developed toward the trend of reduced thickness. The conventional keyboards can be generally divided into two main categories. The first kind of the keyboard is utilizing a guiding structure, and is usually applied on desktop keyboard. The guiding structure is usually formed on a bottom surface of the keycap for guiding a guiding post of a keycap. This kind keyboard provides comfortable and affirmative operating feeling and requires lower manufacturing cost, but often suffers the disadvantage of having thicker physical profile. The other kind of the keyboard is utilizing lower-profiled scissor structures and elastic pieces. Each key structure has a keycap disposed on the scissor structure and the elastic piece. Such kind keyboard is usually used in notebook computer because of its reduced thickness comparing to the keyboard that utilizes conventional guiding structures. However, the material cost and structural complexity for this type of keyboard are generally higher.

For the purpose of reducing the thickness of desktop keyboard with guiding structure, there is a conventional way used the scissor structure to replace the guiding structure. However, the material cost and the manufacturing cost cannot be reduced effectively. Therefore, the development is limited.

In other words, the keyboard with guiding structure has advantages of lower cost, enough pressing stroke and good operating feeling, but the problem is hard to reduce the total thickness. On the contrary, the keyboard with scissor structure has advantage of thin profile, but the disadvantage is hard to reduce the material cost and manufacturing cost. Therefore, it is desirable to propose a novel slim keyboard to overcome the above-mentioned problems.

SUMMARY OF THE INVENTION

The instant disclosure provides a slim key structure and a slim keyboard having the same, which has guiding structure with enough pressing stroke and well operating feeling, lower total thickness, and cheaper cost.

In order to achieve the above mentioned, the instant disclosure provides a slim key structure. The slim key structure includes a lower case, a flexible membrane, an upper case, a keycap, and an elastic piece. The lower case is formed with at least one positioning slot. The flexible membrane is disposed on the lower case, and has at least one post opening corresponding to the at least one positioning slot. The elastic piece is disposed on the flexible membrane. The upper case has at least one hollow guiding cylinder and a central passage. The guiding cylinder protrudes upwardly from a top surface of the upper case and downwardly from a lower surface of the upper case. The downwardly protruding portion of the guiding cylinder is matchingly receivable in the positioning slot of the lower case. The keycap has at least one guiding post and a pushing stem protruded downwardly from a bottom surface thereof. The guiding post is reciprocably received in the at least one guiding cylinder of the upper case. The elastic piece is disposed between the keycap and the flexible membrane in the central passage depressable by the pushing stem against the flexible membrane.

To achieve the above mentioned, the instant disclosure further provides a slim keyboard including a lower case, a flexible membrane, a plurality of elastic pieces, an upper case and a plurality of keycaps. The lower case is formed with a plurality of positioning slots. The flexible membrane is disposed on the lower case, and has a plurality of post openings corresponding to the positioning slots. The upper case is arranged on the flexible membrane. The upper case has a plurality of hollow guiding cylinder and a plurality of central passages formed thereon. The guiding cylinders are protruded upwardly from a top surface of the upper case and downwardly from a lower surface of the upper case. The downwardly protruding portion of the guiding cylinder is matchingly receivable in the positioning slot of the lower case. Each of the keycap has at least one guiding post and a pushing stem extending from a bottom surface thereof. The guiding posts are reciprocably received in the guiding cylinders of the upper case correspondingly. The elastic piece is disposed between the keycap and the flexible membrane in the central passage depressable by the pushing stem against the flexible membrane.

Thus, the instant disclosure has advantage as followed. The present invention utilizes the positioning slot of the lower case as a partial stroke of guiding post of the keycap, so that the total thickness of key structure can be reduced.

For further understanding of the instant disclosure, reference is made to the following detailed description illustrating the embodiments and examples of the instant disclosure. The description is for illustrative purpose only and is not intended to limit the scope of the claim.

DETAILED DESCRIPTION OF THE PREFERRED EMBODIMENTS

First Embodiment

Figure 1:
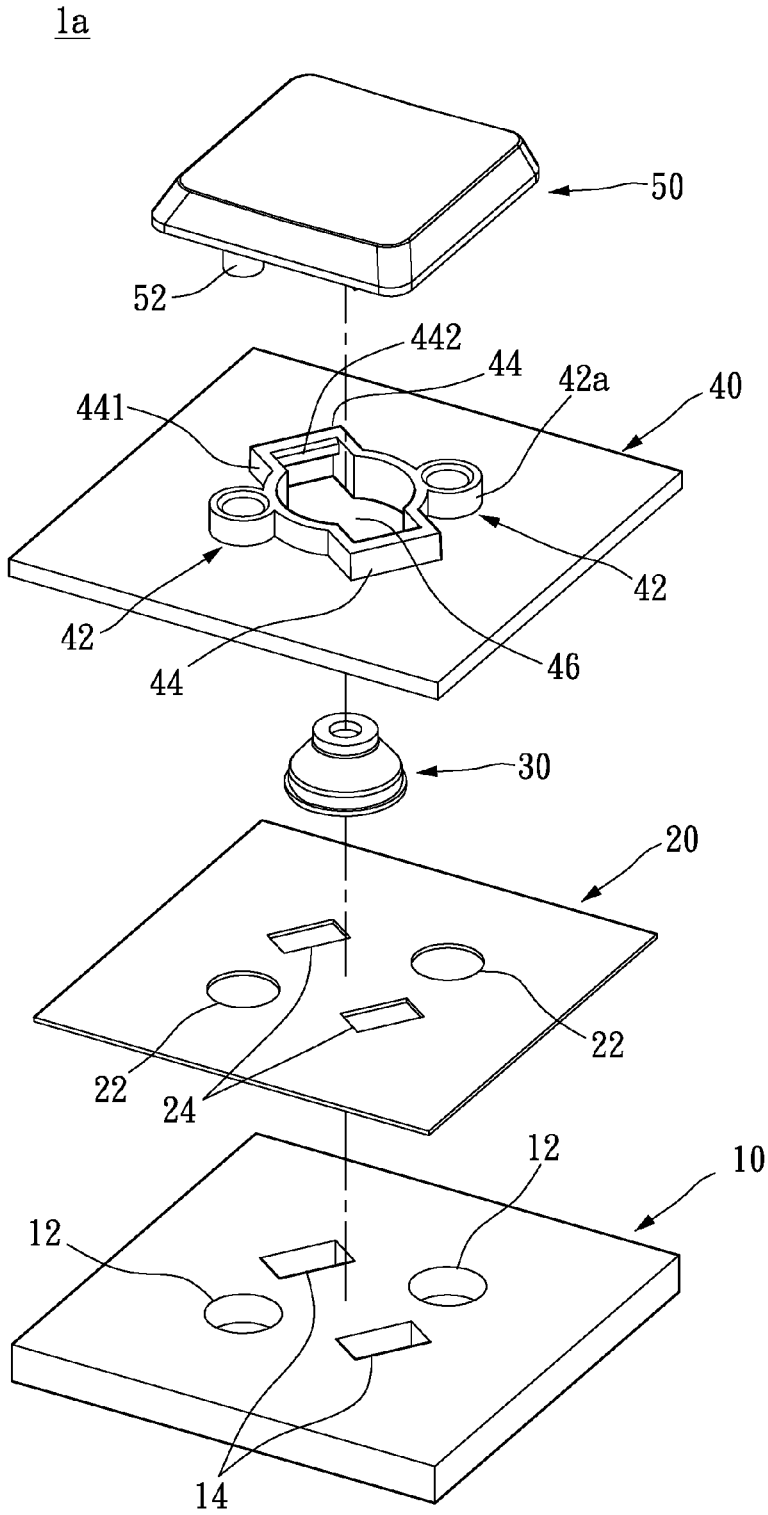
FIG. 1 is a perspective exploded view of a slim key structure of first embodiment according to the present invention.
Figure 2:
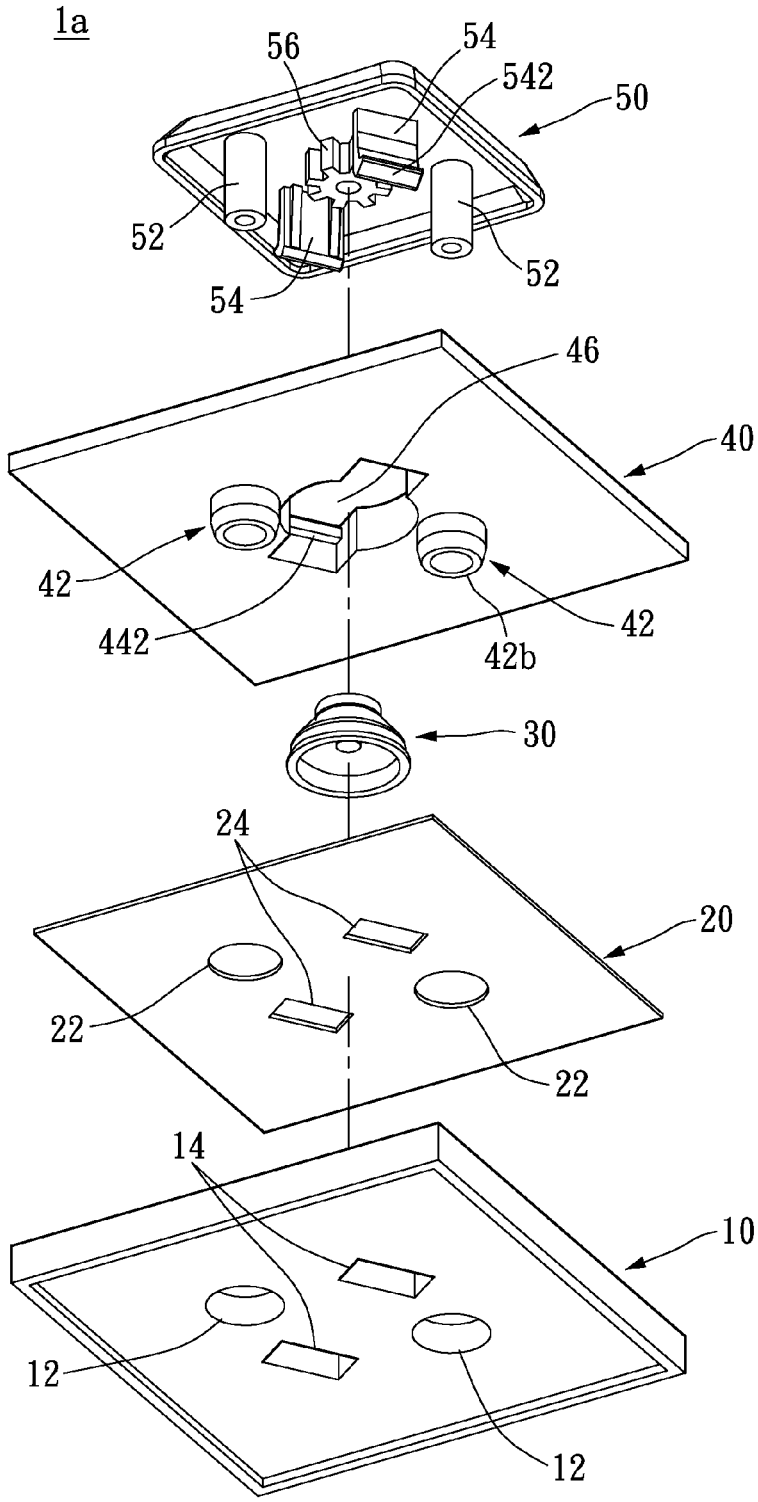
FIG. 2 is another perspective exploded view of the slim key structure of first embodiment according to the present invention.

Please refer to FIG. 1 and FIG. 2, which are perspective exploded view of a slim key structure according to the instant disclosure. The slim key structure 1*a* includes a lower case 10, a flexible membrane 20 disposed on the lower case 10, an elastic piece 30, an upper case 40 disposed on the flexible membrane 20 and a keycap 50. In this embodiment, the elastic piece 30 is arranged under the keycap 50, and disposed on the flexible membrane 20. The flexible membrane 20, or called a conductive membrane, is a three-layer plastic membrane that spreads over the entire keyboard. When the elastic piece 30 is pushed to press the top layer through a hole in the middle layer to contact the bottom layer, a short circuit is created which generates the keystroke that is then sent to the computer.

The lower case 10 is formed with a pair of positioning slots 12, or called yielding slots, which is yielding a little extra room to receive partial stroke of guiding post of the keycap. In this embodiment, the positioning slots 12 are through holes that pass through the lower case 10. However, the positioning slots 12 can be concaved downwardly from a top surface of the lower case 10 and not pass through the lower case 10. Such structure partially uses the thickness of the lower case 10, and has the advantage that the bottom of the lower case 10 is sealed without any holes to prevent undesirable objects from entering the key structure. However, a bottom board is optional and can be omitted to further reduce the assembly and labor cost. The flexible membrane 20 is formed with a pair of post openings 22 corresponding to the pair of positioning slots 12. The upper case 40 has a pair of hollow guiding cylinders 42, and a central passage 46 corresponding to the elastic piece 30. Each of the guiding cylinders 42 protrudes upwardly from a top surface of the upper case 40, which is an upper guiding portion 42*a* (as shown in FIG. 1), and downwardly from a lower surface of the upper case 40, which a lower guiding portion 42*b* (as shown in FIG. 2). The downwardly protruding portions of guiding cylinders 42, the lower guiding portions 42*b*, are matchingly receivable in the positioning slots 12 of the lower case 10. The bottom surface of the keycap 50 is protruded downwardly with a pair of guiding posts 52 and a pushing stem 56. The pair of guiding posts 52 is disposed in the pair of guiding cylinders 42 of the upper case 40 correspondingly. The pushing stem 56 is against a top surface of the elastic piece 30. One characteristics of the present invention is that the positioning slot 12 could be functioned as a partial stroke of the guiding post 52 of the keycap 50, so that the total thickness of the key structure 1*a* is reduced.

In this embodiment, the positioning slot 12 passes through the lower case 10. In accordance with this arrangement, the present invention can further include a bottom board disposed on the bottom surface of the lower case 10 to cover the positioning slots 12.

To avoid the keycap 50 departing from the upper case 40, the bottom surface of the keycap 50 has a pair of retaining latches 54. The upper case 40 has a pair of restricting portions 44 which are engaged with the pair of retaining latches 54. In detail, each of retaining latches 54 has a lower barb 542 protruded outwardly from an end thereof, and each restricting portion 44 is formed with an upper barb 442 to hook with the lower barb 542.

Concerning the detail of the upper barb 442, the upper case 40 further includes a partition 441 protruded upwardly from an edge of the central passage 46. The central passage 46 is opened to the restricting portion 44. The upper barb 442 of the restricting portion 44 is formed on the partition 441 and extended toward the central passage 46.

Figure 3A:
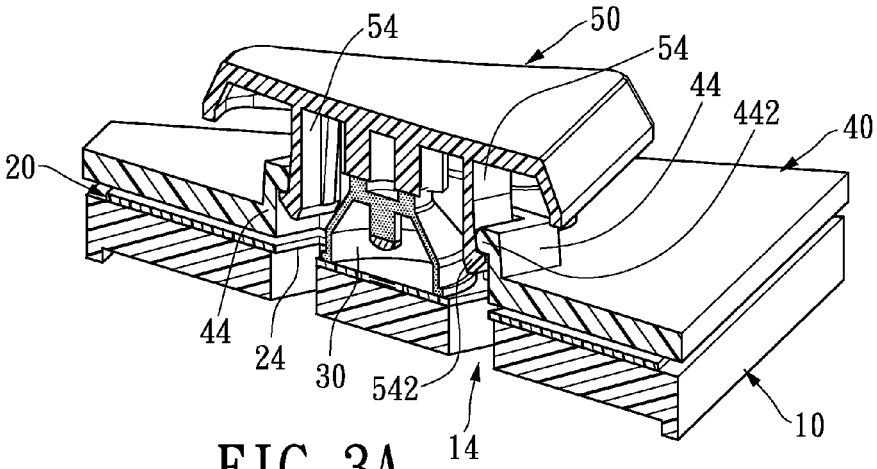
FIGS. 3A to 3C are cross-sectional views of the slim key structure of first embodiment according to the present invention.
Figure 3B:
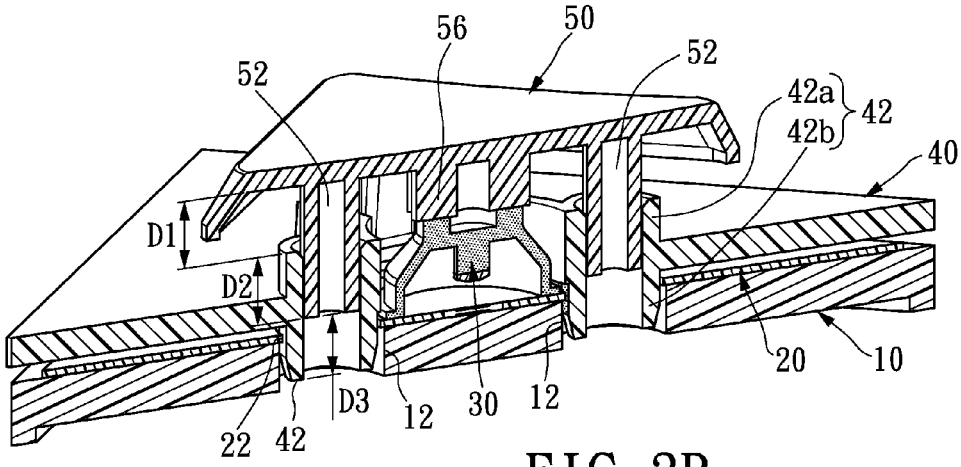
Figure 3C:
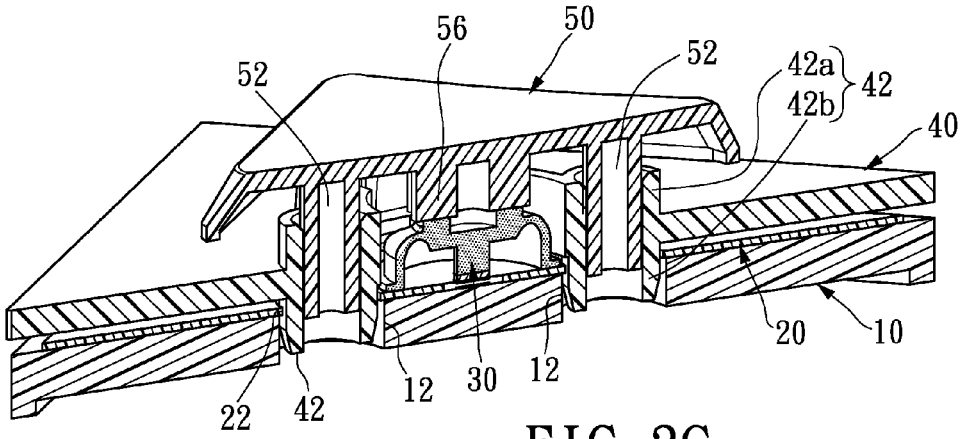

As shown in FIGS. 3A to 3C, the key structure 1*a* of this embodiment is shown in assembled condition. The lower barb 542 is movably disposed under the upper barb 442, so that the restricting portion 44 can restrict the stroke of the retaining latch 54. The pair of retaining latches 54 has some elasticity and can enter the pair of restricting portions 44 by an external force.

Please refer to FIG. 1 and FIG. 2. In accordance with the restricting structure, the lower case 10 of this embodiment is formed with a pair of latch slots 14 corresponding to the pair of retaining latches 54. Besides, the flexible membrane 20 is also formed with a pair of latch openings 24 corresponding to the pair of latch slots 14. Similar to the positioning slot 12 of the lower case 10, the latch slot 14 can pass through the lower case 10 or not pass through the lower case 10.

In this embodiment, the pair of retaining latches 54 and the pair of guiding posts 52 are arranged alternately and mutually symmetric around a periphery of the pushing stem 56 and the elastic piece 30. Such structure also can reduce the thickness of the key structure. Please refer to FIGS. 3A to 3B, which are assembled cross-sectional views of the slim key structure. FIG. 3A shows the restricting structure of this embodiment arranged at a periphery of the elastic piece 30. The lower barb 542 of the retaining latch 54 is engaged under the upper barb 442 of the restricting portion 44, and can downward pass through the upper case 40, the latch opening 24 of the flexible membrane 20, and the latch slot 14 of the lower case 10. Comparing with conventional keyboard where the retaining latch and the pushing stem are arranged in tube-shape above the elastic piece and the restricting portion is also arranged above the elastic piece, this embodiment arranges the restricting structure composed of the retaining latch 54 and the restricting portion 44 around the elastic piece 30, that this embodiment can reduce some thickness of the key structure 1*a*.

Refer to FIG. 3B and FIG. 3C, which are cross-sectional views of the slim key structure pressed and not pressed along the guiding post 52 according to the present invention. In this embodiment, the guiding post 52 is inserted into the guiding cylinder 42 to form a guiding structure. The upper guiding portion 42*a* of the guiding cylinder 42 is arranged outside the elastic piece 30, the lower guiding portion 42*b* is downwardly passed through the post opening 22 of the flexible membrane 20 and the positioning slot 12 of the lower case 10. The guiding post 52 of this embodiment has a length larger than or equal to that of the guiding cylinder 42. The length of each guiding post 52 is divided into an upper stroke D1 and a guiding stroke D2. The length of each guiding cylinder 42 is divided into a guiding stroke D2 and a lower stroke D3. This present invention moves most of the lower stroke D3 into the positioning slot 12 of the lower case 10, so that the total thickness of the key structure is reduced effectively.

The thickness of conventional key structure is composed of not only the upper stroke D1, the guiding stroke D2, and the lower stroke D3, but also the keycap itself, a flexible membrane and a lower case. Besides, the upper stroke D1, the guiding stroke D2, and the lower stroke D3 are all disposed on the flexible membrane 20, and further, on an elastic bottom layer having connected many elastic pieces. Compare with the conventional structure, the upper and lower strokes of the guiding structure and the length of guidance are arranged through the flexible membrane, and the lower case 10 is employed partially or wholly, so that the thickness of the key structure (or keyboard) of the present invention is reduced.

Second Embodiment

Figure 4:
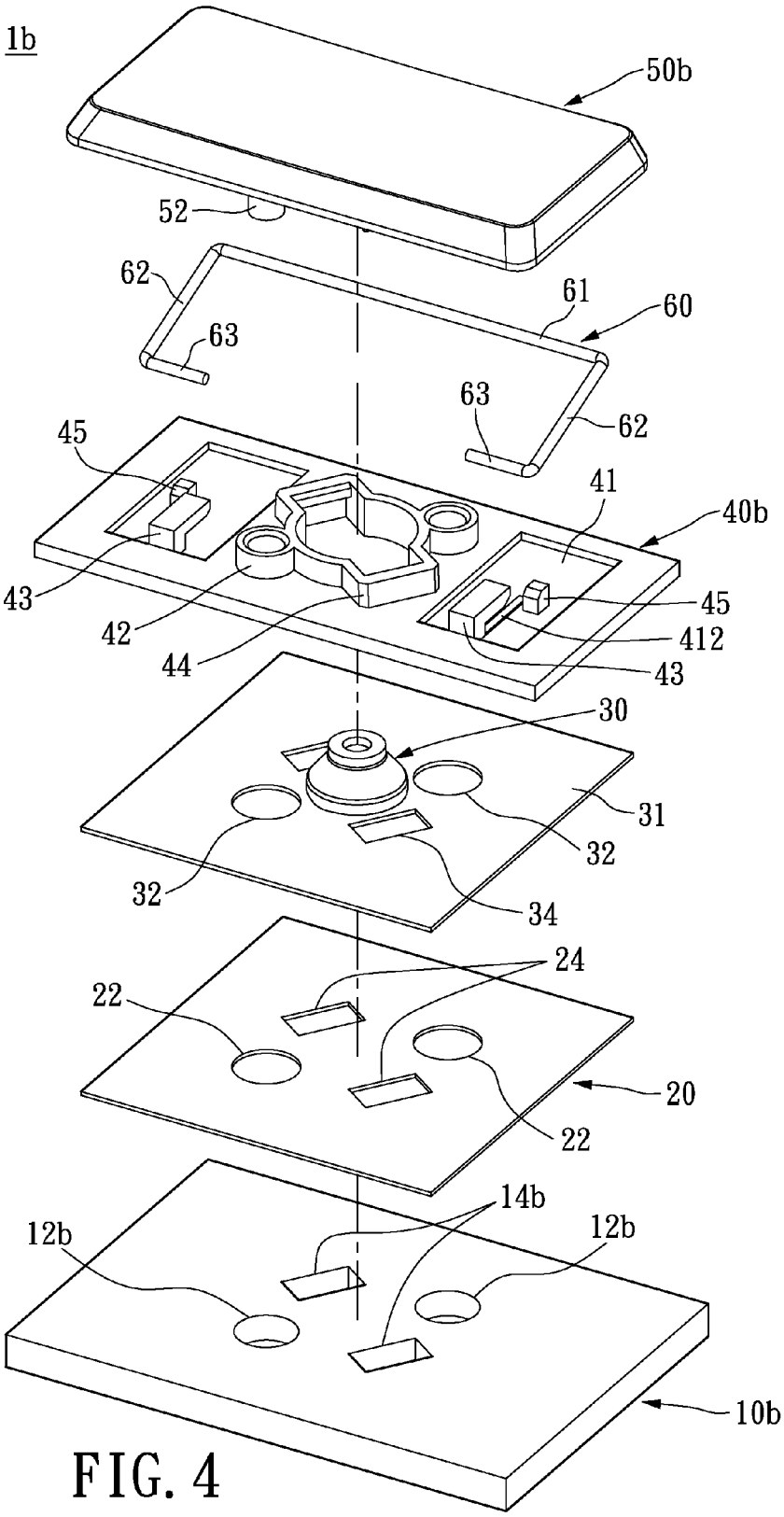
FIG. 4 is a perspective exploded view of a slim key structure of second embodiment according to the present invention.
Figure 5:
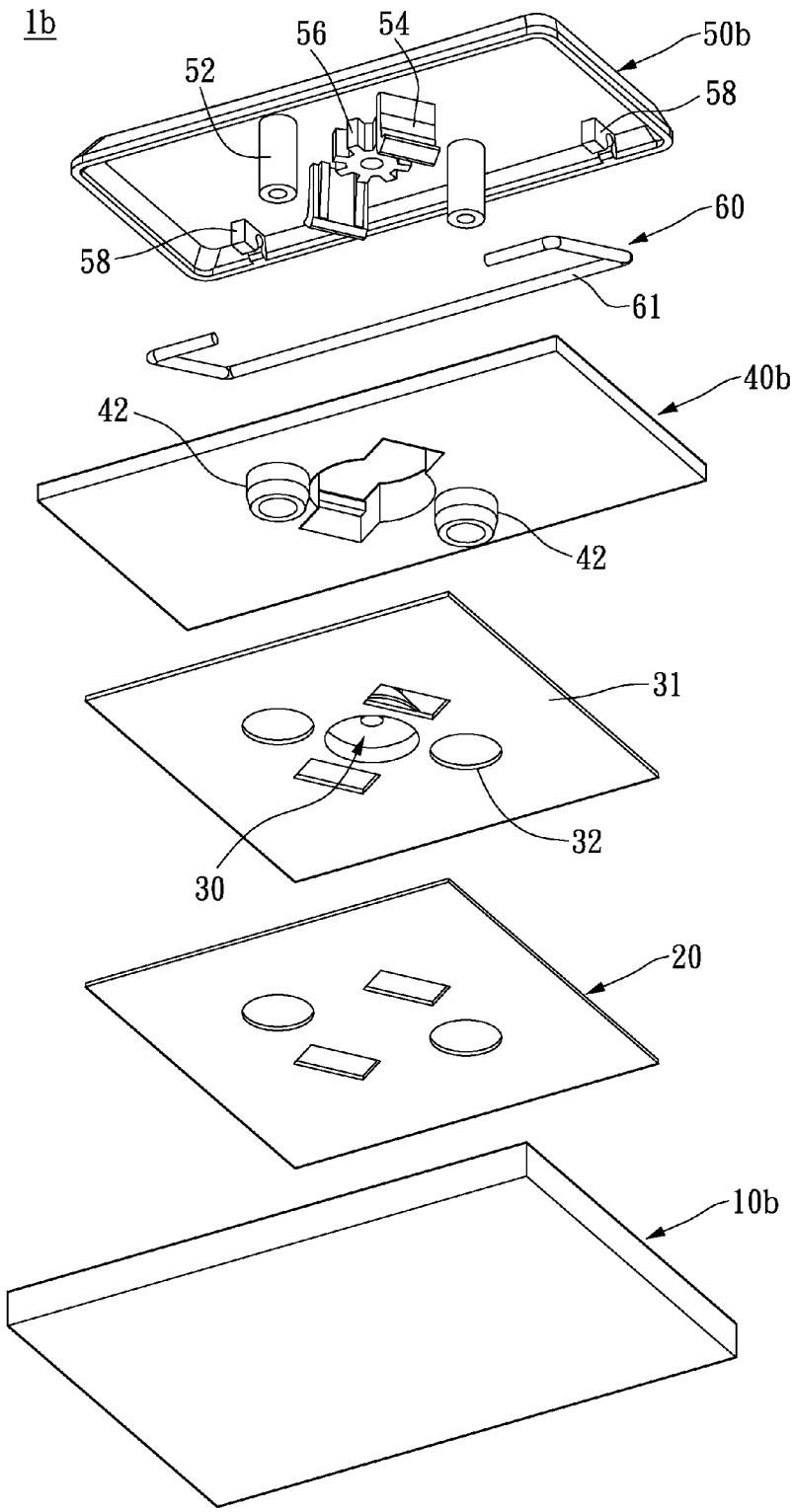
FIG. 5 is another perspective exploded view of a slim key structure of second embodiment according to the present invention.

Please refer to FIG. 4 and FIG. 5, which are perspective views of a slim key structure of second embodiment according to the present invention. The second embodiment, different from the above embodiment, has a wider keycap 50*b*, such as Shift key or Enter key, and further includes a balance rack 60 disposed between the keycap 50*b* and the upper case 40*b* to maintain a balanced pressing stroke for the keycap 50*b*. Besides, the elastic pieces 30 are integrally formed with a bottom layer 31. The bottom layer 31 can be integrally formed with the elastic pieces 30 by plastic injection molding technology. The bottom layer 31 is disposed on the flexible membrane 20. By this arrangement, the time of assembling many elastic pieces 30 on the flexible membrane 20 can be reduced. The bottom layer 31 is formed with a pair of post holes 32 corresponding to the pair of post openings 22, for the guiding cylinders 42 passing therethrough, and a pair of latch holes 34, for the retaining latches 54 passing therethrough. This embodiment combined the plurality of elastic pieces 30 with the bottom layer 31 can reduce assembly time.

It is to be noted that, the bottom layer 31 in this embodiment of FIG. 4 can be a non-transparent isolating bottom layer, and for example, as light shade. The isolating bottom layer can be (PET, Polyethylene terephthalate) film, such as Mylar®. The elastic piece 30 is attached to the isolating bottom layer 31.

It is worth noting the lower case 10*b* of this this embodiment has positioning slots 12*b* and latch slots 14*b* not passed therethrough, as shown in FIG. 5. Such structure employs the thickness of the lower case 10*b* partially as the pressing stroke of the key structure, and has advantage that the lower case 10*b* without holes at bottom thereof to avoid miscellaneous articles entering the key structure. It does not need a bottom board to cover the lower case 10*b* and the assembling time of the bottom board is omitted.

The assembly of the balance rack 60 is described as followed. Refer to FIG. 4, the balance rack 60 has an upper rod 61, a pair of erecting rods 62 extended downwardly from two sides of the upper rod 61, and a pair of lower rods 63 extended inwardly from bottom ends of the pair of erecting rods 62. Refer to FIG. 5, a bottom surface of the keycap 50*b* has a pair of pivoting parts 58. The upper rod 61 is pivotably connected to the pair of pivoting parts 58.

Please refer to FIG. 4, two sides of the upper case 40*b* have a pivotal structure cooperated with the balance rack 60, respectively. Each pivotal structure has a concave cavity 41, an L-shaped holding arm 43 formed in the concave cavity 41, a blocking bump 45, and a rib 412 matched with the holding arm 43.

Figure 6A:
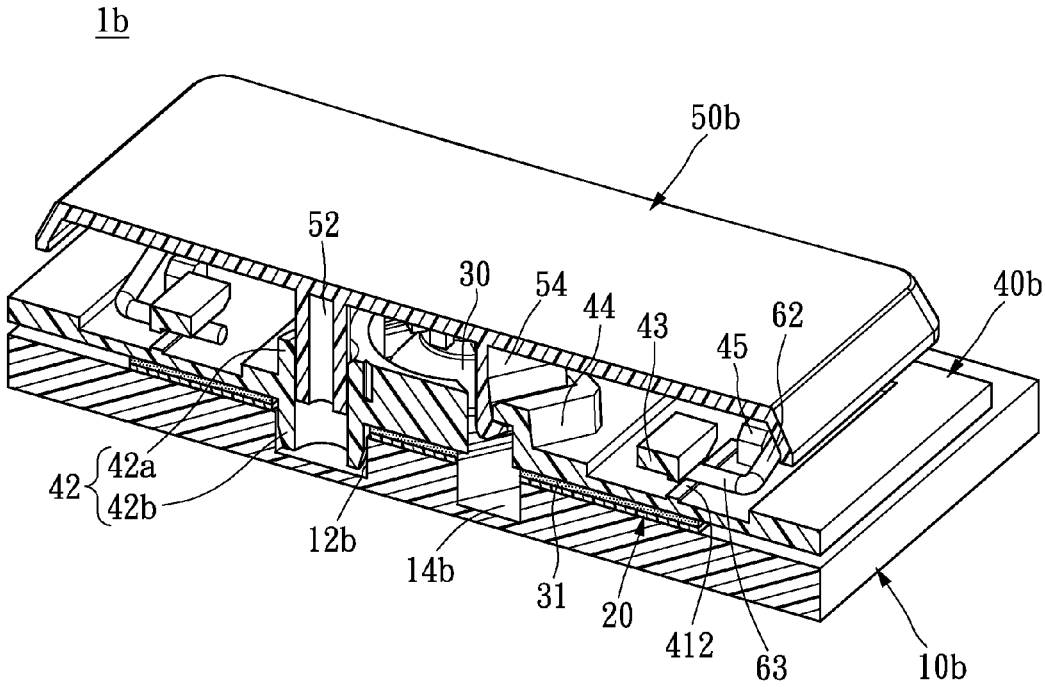
FIGS. 6A to 6B are cross-sectional views of the slim key structure of second embodiment according to the present invention.
Figure 6B:
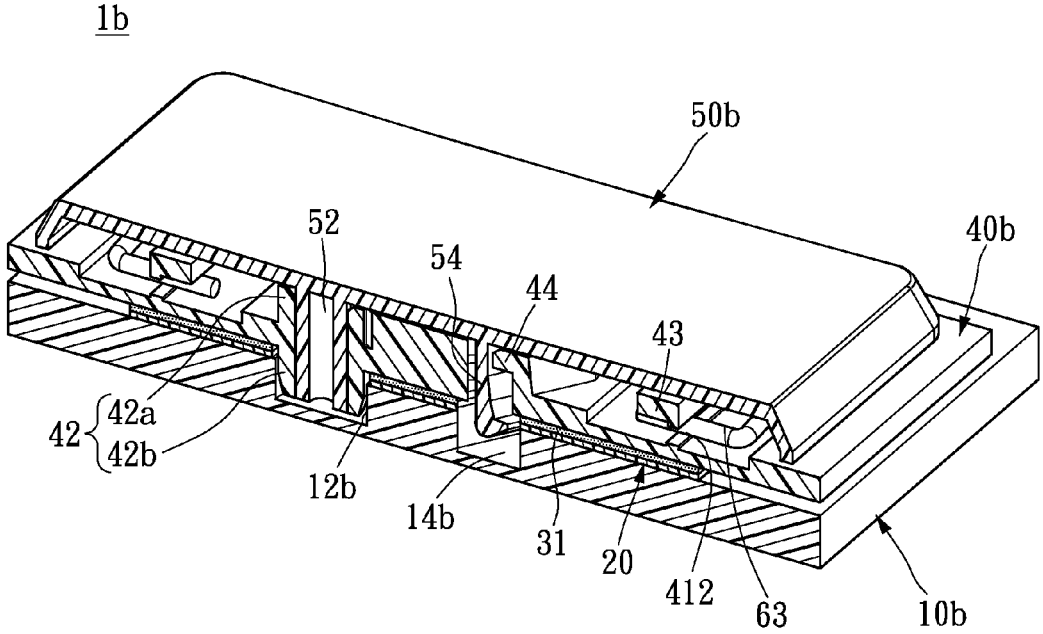

Please refer to FIG. 6A and FIG. 6B, which is an assembled cross-sectional view taken along a traverse line of the keycap 50*b* according to this embodiment, that is along the guiding post 52 and the retaining latch 54. After this embodiment is assembled, the erecting rod 62 is arranged at an outer side of the blocking bump 45, and the lower rod 63 is disposed between the holding arm 43 and the rib 412. In this embodiment, after the keycap 50*b* is pressed, the balance rack 60 substantially is laid in the concave cavity 41. The depth of concave cavity 41 is substantially equal to the thickness of the balance rack 60. In other words, the concave cavity 41 also can be used to reduce some thickness of the key structure.

Third Embodiment

Figure 7:
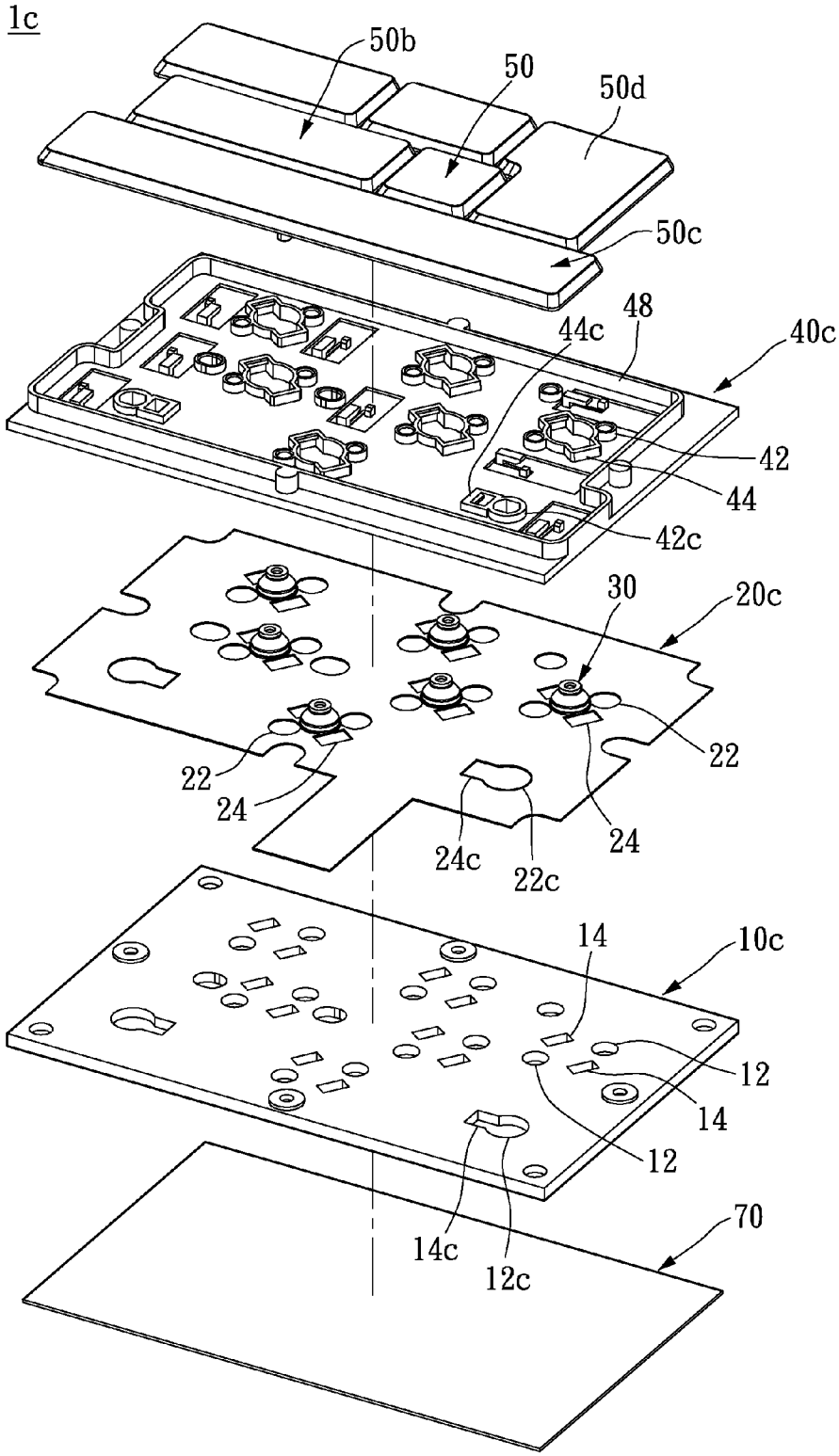
FIG. 7 is a perspective exploded view of a slim key structure of third embodiment according to the present invention.
Figure 8:
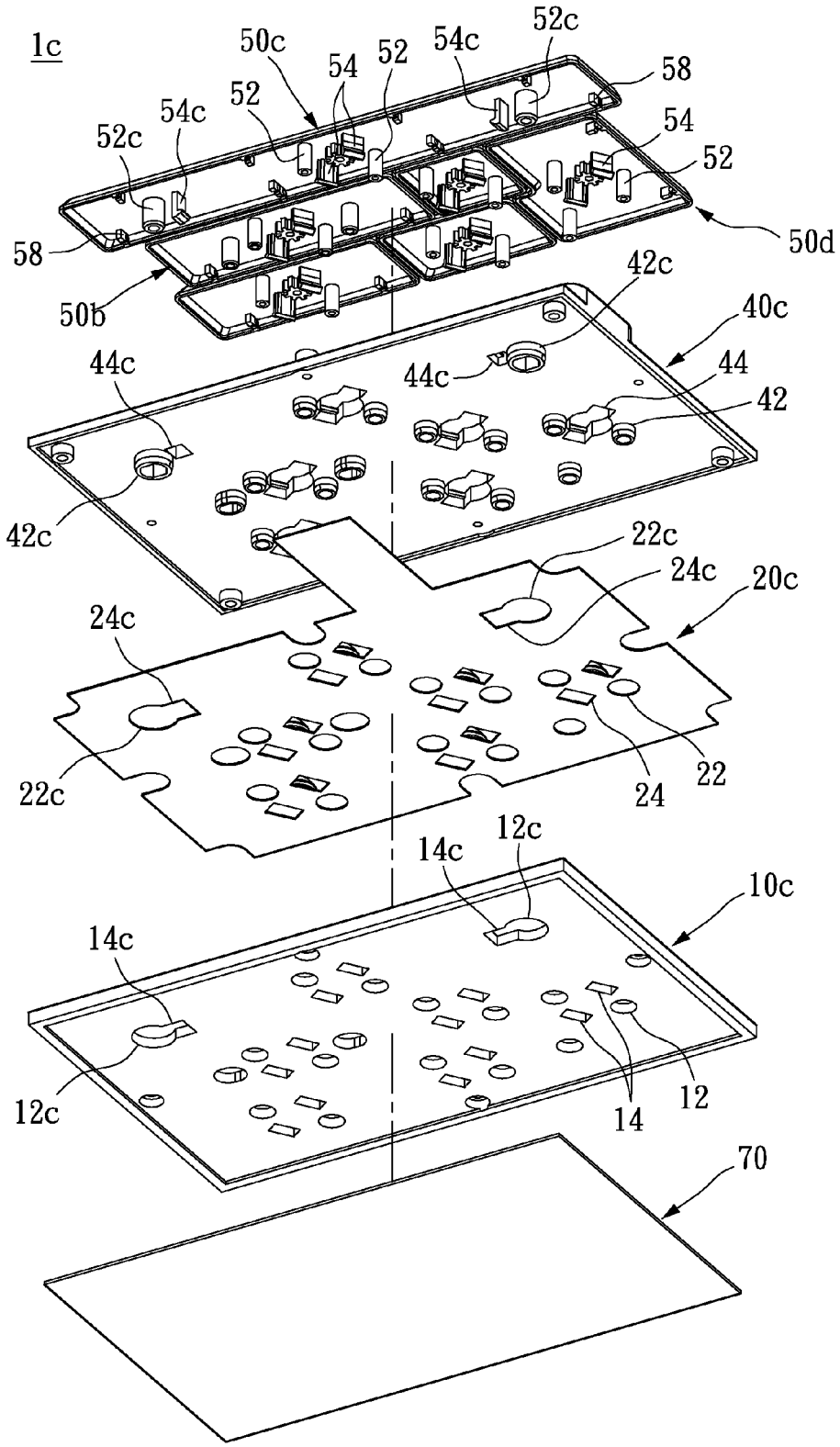
FIG. 8 is another perspective exploded view of a slim key structure of third embodiment according to the present invention.

Refer to FIG. 7 and FIG. 8, which are perspective exploded views of the slim keyboard according to the present invention. A slim keyboard 1*c* with six different keycaps 50, 50*b*, 50*c*, 50*d* is shown in this embodiment. Most of the keycaps are similar with the above-mentioned. This embodiment has a wider keycap 50*c*, such as space key. The keycap 50*c* has a pair of guiding posts 52 and a pair of retaining latches 54, and further includes a pair of outer guiding posts 52*c* formed at an outer side of the pair of guiding posts 52 and a pair of outer retaining latches 54*c* formed at an outer side of the pair of retaining latches 54, which are used enhance balance. In detail, the pair of outer guiding posts 52*c* and the pair of outer retaining latches 54*c* are disposed at a bottom surface of the keycap 50*c* near two ends thereof. The outer guiding posts 52*c* are disposed at an outer side of the outer retaining latch 54*c*.

In this embodiment, to cooperate with the outer guiding posts 52*c*, the upper case 40*c* further includes a pair of outer guiding cylinders 42*c* corresponding to the pair of outer guiding posts 52*c*. The flexible membrane 20*c* further includes a pair of outer posts openings 22*c* corresponding to the pair of outer guiding cylinders 42*c*. The lower case 10*c* further includes a pair of outer positioning slots 12*c* corresponding to the pair of outer post openings 22*c*.

In this embodiment, to cooperate with the outer retaining latches 54*c*, the upper case 40*c* further includes a pair of outer restricting portions 44*c* corresponding to the pair of outer retaining latches 54*c*, which helped to restrict the outer retaining latches 54*c*. The flexible membrane 20*c* further includes a pair of outer latch openings 24*c* corresponding to the pair of outer restricting portions 54*c*. The lower case 10*c* further includes a pair of outer latch slots 14*c* corresponding to the pair of outer latch openings 24*c*. A supplementary point of this embodiment, the outer guiding posts 52*c* is adjacent to the outer retaining latches 54*c*, so that the outer positioning slot 12*c* of the lower case 10*c* communicates with outer latch slot 14*c*. The outer post opening 22 of the flexible membrane 20*c* communicates with the outer latch opening 24*c*.

This embodiment also can have a wider balance rack (not shown) to match with the width of the keycap 50*c*, and has a shape similar to the above-mentioned balance rack of second embodiment. The keycap 50*c* a plurality of pivoting parts 58 formed on a bottom surface thereof, and the upper case 40*c* has pivotal structure similar to that of second embodiment to connect the balance rack.

Further, the upper case 40*c* includes a margin wall 48, which is encircled the keycaps. In this embodiment, a bottom board 70 is disposed on a bottom surface of the lower case 10*c* to cover the through-type positioning slots 12, 12*c* and the latch slots 14, 14*c*.

In the above-mentioned embodiments, the quantity of the retaining latch and the guiding post is not restricted in one pair, which can be at least one. For example, each of keycap has a guiding post and a retaining latch respectively. Correspondingly, the quantity of the positioning slot 12, the post opening 22, the guiding cylinder 42 and the guiding post 52 is not restricted in one pair, which can be at least one. And, for example, the keycap 50*d* as shown in FIG. 7 and FIG. 8 can be deemed as Enter key, which has a pair of retaining latches 52 and three guiding posts 54. The balance rack can be disposed at right side of the keycap 50*d* erectly.

According to the above describing, the slim key structure and slim keyboard of the present invention utilizes the positioning slot 12 of the lower case 10 as partial stroke of the guiding post 52 of the keycap 50, so that the total thickness of the key structure can be reduced. Besides, the retaining latch 54 and the guiding post 52 are arranged at outer side of the pushing stem 56 and the elastic piece 30, which also can reduce the thickness of the key structure.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A slim key structure, comprising:

a lower case having at least one positioning slot;

a flexible membrane disposed on the lower case, the flexible membrane having at least one post opening in corresponding alignment with the at least one positioning slot;

an upper case disposed on the flexible membrane having at least one hollow guiding cylinder and a central passage defined thereon, the guiding cylinder protruding upwardly from a top surface of the upper case and downwardly from a lower surface of the upper case, the downwardly protruding portion of the guiding cylinder being matchingly receivable in the positioning slot of the lower case;

a keycap having at least one guiding post and a pushing stem protruding downwardly from a bottom surface thereof, the guiding post being reciprocably received in the at least one guiding cylinder of the upper case; and an elastic piece, disposed between the keycap and the flexible membrane in the central passage depressable by the pushing stem against the flexible membrane.

2. The slim key structure as claimed in claim 1, wherein the positioning slot is concaved from a top surface of the lower case and not through the lower case.

3. The slim key structure as claimed in claim 1, wherein a length of the at least one guiding post is larger or equal to that of the at least one guiding cylinder.

4. The slim key structure as claimed in claim 1, wherein the elastic piece is disposed on the flexible membrane.

5. The slim key structure as claimed in claim 1, wherein the elastic piece is integrally connected to a bottom layer, the bottom layer disposed on the flexible membrane, the bottom layer having at least one post hole corresponding to the at least one post opening.

6. The slim key structure as claimed in claim 1, wherein the elastic piece is adhered to an opaque isolating bottom layer, the isolating bottom layer disposed on the flexible membrane, the isolating bottom layer having at least one post hole corresponding to the at least one post opening.

7. The slim key structure as claimed in claim 1, further comprising a balance rack arranged between the keycap and the upper case.

8. The slim key structure as claimed in claim 1, wherein the at least one positioning slot is through the lower case.

9. The slim key structure as claimed in claim 8, further comprising a bottom board disposed under the lower case and covered the at least one positioning slot.

10. The slim key structure as claimed in claim 1, wherein the bottom surface of the keycap further includes at least one retaining latch, wherein the upper case has at least one restricting portion, the retaining latch engaged with the restricting portion, the restricting portion limited a displacement of the retaining latch.

11. The slim key structure as claimed in claim 10, wherein the quantity of retaining latch and guiding post are all one pair, the pair of retaining latches and the pair of guiding posts are arranged alternately and mutually symmetric around a periphery of the pushing stem and the elastic piece.

12. The slim key structure as claimed in claim 11, wherein the keycap further includes a pair of outer guiding posts in addition to the pair of guiding posts, the upper case further includes a pair of outer guiding cylinders corresponding to the pair of outer guiding posts, the flexible membrane further includes a pair of outer post openings corresponding to the pair of outer guiding cylinders, the lower case further includes a pair of outer positioning slots corresponding to the pair of outer post openings.

13. The slim key structure as claimed in claim 11, wherein the keycap further includes a pair of outer retaining latches in addition to the pair of retaining latches, the upper case further includes a pair of outer restricting portions corresponding to the pair of outer retaining latches, the flexible membrane further includes a pair of outer latch openings corresponding to the pair of outer restricting portions, the lower case further includes a pair of outer latch slots corresponding to the pair of outer latch openings.

14. The slim key structure as claimed in claim 10, wherein the lower case is formed with at least one latch slot corresponding to the at least one retaining latch, and the flexible membrane is formed with at least one latch opening corresponding to the at least one latch slot.

15. The slim key structure as claimed in claim 14, wherein the upper case further includes a partition protruded upwardly from an edge of the central passage, wherein the central passage is opened to the restricting portion, wherein the restricting portion has a barb formed on the partition toward the central passage, the barb is engaged with the retaining latch.

16. The slim key structure as claimed in claim 14, wherein the at least one latch slot is passed through the lower case.

17. The slim key structure as claimed in claim 14, wherein the at least one latch slot is not passed through the lower case.

18. A slim keyboard, comprising:

a lower case having a plurality of positioning slots;

a flexible membrane disposed on the lower case, the flexible membrane having a plurality of post openings corresponding to the positioning slots;

an upper case disposed on the flexible membrane, the upper case having a plurality of hollow guiding cylinders and a plurality of central passages, each of the guiding cylinder protruding upwardly from a top surface of the upper case and downwardly from a lower surface of the upper case, the downwardly protruding portion of the guiding cylinder being matchingly receivable in the positioning slot of the lower case;

a plurality of keycaps, each of the keycaps having at least one guiding post and a pushing stem protruding downwardly from a bottom surface thereof, the guiding posts reciprocably received in the guiding cylinders of the upper case correspondingly; and a plurality of elastic pieces, each elastic piece disposed between the keycap and the flexible membrane in the central passage depressable by the pushing stem against the flexible membrane.

19. The slim keyboard as claimed in claim 18, wherein the upper case further includes a margin wall surrounded the keycaps.

* * * * *